US010504710B2

(12) United States Patent
Knutas

(10) Patent No.: US 10,504,710 B2
(45) Date of Patent: Dec. 10, 2019

(54) MULTIPOLE WITH A HOLDING DEVICE FOR HOLDING THE MULTIPOLE, HOLDING DEVICE OF A MULTIPOLE, MASS SPECTROMETER WITH SUCH A MULTIPOLE, MOUNTING UNIT FOR POSITIONING THE MULTIPOLE AND METHOD FOR POSITIONING A HOLDING DEVICE RELATIVE TO A MULTIPOLE

(71) Applicant: VACUTEC Hochvakuum- & Praezisionstechnik GmbH, Bremen (DE)

(72) Inventor: Roman Knutas, Delmenhorst (DE)

(73) Assignee: VACUTEC Hochvakuum- & Praezisionstechnik GmbH, Bremen (DE)

( * ) Notice: Subject to any disclaimer, the term of this patent is extended or adjusted under 35 U.S.C. 154(b) by 0 days.

(21) Appl. No.: 15/939,960

(22) Filed: Mar. 29, 2018

(65) Prior Publication Data

US 2018/0286654 A1 Oct. 4, 2018

(30) Foreign Application Priority Data

Apr. 3, 2017 (DE) ..... 10 2017 107 137

(51) Int. Cl.
*H01J 49/06* (2006.01)
*H01J 49/42* (2006.01)

(52) U.S. Cl.
CPC ..... *H01J 49/068* (2013.01); *H01J 49/063* (2013.01); *H01J 49/4255* (2013.01); *H01J 49/4215* (2013.01)

(58) Field of Classification Search
CPC .... H01J 49/068; H01J 49/063; H01J 49/4255; H01J 49/4215

(Continued)

(56) References Cited

U.S. PATENT DOCUMENTS 2,939,952 A 6/1960 Paul et al.
5,242,318 A * 9/1993 Plass ..... H01R 13/719 439/620.1

(Continued)

FOREIGN PATENT DOCUMENTS

DE 944900 C 6/1956
DE 10 2012 211 586 A1 1/2013

(Continued)

OTHER PUBLICATIONS

European Search Report in EP 18165238.9-1203, dated Aug. 20, 2018, with English translation of relevant parts.

*Primary Examiner* — Nicole M Ippolito
(74) *Attorney, Agent, or Firm* — Collard & Roe, P.C.

(57) ABSTRACT

The invention relates to a multipole (32) with a holding device (10) for holding the multipole (32), for example a quadrupole in a mass spectrometer or on a mounting unit (40), wherein the holding device (10) is arranged on the multipole (32).

Figure 1A:
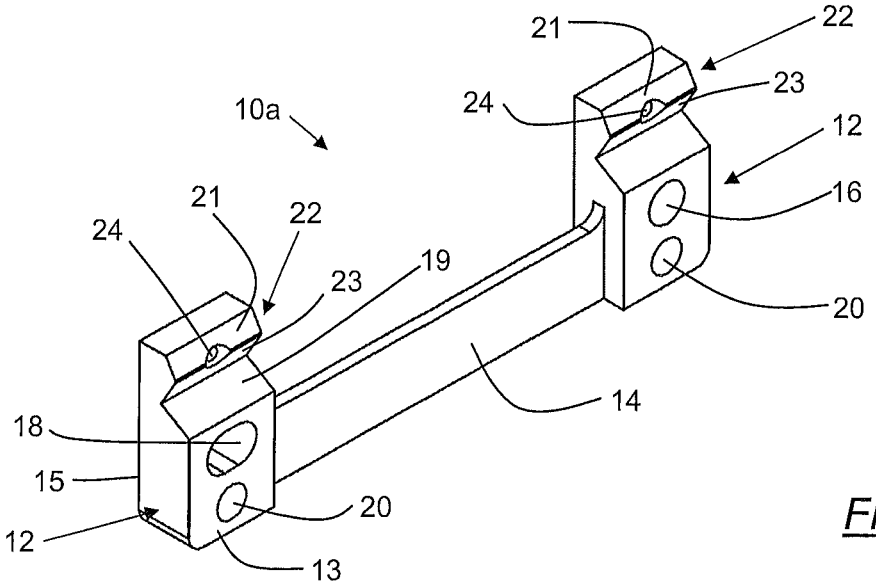

For attaching the multipole (32) to a receiving device (36, 36*a*) for receiving the holding device (10), the holding device (10) has one or more planar supporting surfaces (13, 15). The holding device (10) is attached to surfaces (30) of the multipole (32) that are manufactured together with electrodes (26A, 26B) of the multipole (32) in one work step.

Furthermore, the invention relates to a holding device (10) of such a multipole (32), a mass spectrometer with such a multipole (32), a mounting unit (40) with a receiving device (36, 36*a*) for positioning a holding device (10) relative to such a multipole (32) and a method for positioning a holding device (10) relative to the multipole (32).

14 Claims, 7 Drawing Sheets

(58) Field of Classification Search
USPC ..... 250/281, 282, 283, 292
See application file for complete search history.

(56) References Cited

U.S. PATENT DOCUMENTS

| | | | | |
|---|---|---|---|---|
| 5,459,315 | A | 10/1995 | Waki | |
| 6,776,661 | B2 * | 8/2004 | Dingenotto | H01R 13/7195 439/620.09 |
| 7,348,552 | B2 | 3/2008 | Laser | |
| 8,481,929 | B2 | 7/2013 | Steiner et al. | |
| 8,492,713 | B2 | 7/2013 | Steiner et al. | |
| 9,190,252 | B2 | 11/2015 | Laser et al. | |
| 2004/0245460 | A1 | 12/2004 | Tehlirian et al. | |
| 2005/0167584 | A1 * | 8/2005 | Kernan | H01J 49/063 250/290 |
| 2006/0027745 | A1 * | 2/2006 | Rebettge | H01J 9/14 250/292 |
| 2007/0176095 | A1 | 8/2007 | Tong et al. | |
| 2008/0185518 | A1 | 8/2008 | Syms | |
| 2009/0039281 | A1 * | 2/2009 | Kawasaki | G01N 23/20 250/396 R |
| 2011/0240850 | A1 | 10/2011 | Wright et al. | |
| 2013/0015341 | A1 | 1/2013 | Steiner et al. | |
| 2013/0015347 | A1 * | 1/2013 | Steiner | H01J 49/063 250/288 |
| 2015/0102213 | A1 * | 4/2015 | Laser | H01J 49/06 250/281 |

FOREIGN PATENT DOCUMENTS

| | | | |
|---|---|---|---|
| DE | 10 2012 211 587 | A1 | 1/2013 |
| DE | 10 2012 211 593 | A1 | 1/2013 |
| DE | 10 2013 111 254 | A1 | 4/2015 |
| EP | 1 657 737 | A2 | 5/2006 |

* cited by examiner

MULTIPOLE WITH A HOLDING DEVICE FOR HOLDING THE MULTIPOLE, HOLDING DEVICE OF A MULTIPOLE, MASS SPECTROMETER WITH SUCH A MULTIPOLE, MOUNTING UNIT FOR POSITIONING THE MULTIPOLE AND METHOD FOR POSITIONING A HOLDING DEVICE RELATIVE TO A MULTIPOLE

CROSS REFERENCE TO RELATED APPLICATIONS

Applicant claims priority under 35 U.S.C. § 119 of German Application No. 10 2017 107 137.7 filed on Apr. 3, 2017, the disclosure of which is incorporated by reference.

The invention relates to a multipole, in particular a quadrupole. The invention further relates to a holding device of such a multipole, a mass spectrometer with such a multipole, a mounting unit with a receiving device for positioning a holding device on such a multipole and a method for positioning a holding device with respect to the multipole.

In the field of mass spectrometry, multi-pole electrode devices, also called multipoles, have been known in the prior art for several decades, for example from the German patent specification DE 944900. The electrode device shown there serves in a mass spectrometer as an analyzer for separation or separate detection of ions according to their mass-to-charge ratio. For this purpose, a mass spectrometer essentially comprises three components: an ion source, an analyzer which serves as a mass filter, and a detector. In the case of such multipole mass filters, as known for example from the above patent specification, the separation process works without a magnetic field.

In a quadrupole mass spectrometer, such a multipole or analyzer is designed as a quadrupole. Such a quadrupole comprises four rod electrodes, for example four metal rods, which are arranged parallel to each other, the points of intersection of their longitudinal axes with a plane perpendicular to them forming a square. Diagonally opposite electrodes are held at the same potential, which is composed of a DC voltage component and an AC voltage component. Each pair of diagonally opposite electrodes is thus supplied with a DC and high frequency voltage, wherein the two high frequency voltages are phase-shifted by 180°. The ions to be separated are transmitted as a fine ion beam in the longitudinal direction of the electrodes into the field of the quadrupole.

The applied AC and DC voltage causes a movement of the ions on defined trajectories through the quadrupole, whereby outside stable boundary conditions a collision of the ions with the electrodes occurs, so that the ions are neutralized and therefore no longer reach the detector. Thereby, peripheral areas of the electrodes can be unstable zones for ions and thus contribute to defocusing. This is already known from the prior art.

From DE 10 2013 111 254 A1, for example, an electrode device is known, which ensures a precise alignment of the electrodes to each other and thus leads to a high analytical measurement accuracy. Furthermore, the invention provides an electrode device with pre- and/or post-filter, which are arranged before or after a main mass filter. These pre- and post-filters are used for inducing and diverting the ion beam and thus the focusing of the ion beam, whereby an increased transmission rate of the ions and consequently a higher resolution of the mass spectrometer can be achieved. The various sections of the electrodes acting as mass filters serve as ion-optical lenses and the entire electrode device thus constitutes an ion-optical element, in particular in a mass spectrometer.

The precise alignment of the electrodes relative to each other is essential for the analytical accuracy of measurement and takes place thus by the attachment of the electrodes to at least one support element. The support elements are joined together with high positional accuracy to form an electrode device, thus achieving a high analytical measurement accuracy of a mass spectrometer. When mounted in a mass spectrometer, the electrode device is fixed by means of the support elements in the mass spectrometer. For this purpose, the support elements are arranged, for example, annularly in a front and a rear region around the electrodes or a ring of insulating material is arranged around the support elements at the end faces of the multipole. The electrode device thus has rotationally symmetrical supporting surfaces, with which this electrode device rests in a mass spectrometer, in particular at a correspondingly corresponding receiving device within the mass spectrometer. However, such rotationally symmetric supporting surfaces do not allow high-precision positioning and alignment of the electrode device or multipole, for example within a mass spectrometer.

Further prior art regarding holding devices are shown in US 2004/0245460 A1, US 2007/0176095 A1, U.S. Pat. No. 5,459,315, DE 10 2012 211 593 A1, US 2011/0240850 A1, US 2008/0185518 A1 and DE 10 2012 211 586 A1.

The problem underlying the present invention is to provide a multipole with a holding device which permits exact positioning of the multipole and simplified insertion and removal of the multipole, for example in a mass spectrometer. Furthermore, the object of the invention is to make a contribution to increasing the measuring accuracy of mass spectrometers.

The invention solves this problem with a multipole with a holding device for holding the multipole with the features according to one aspect of the invention as well as a holding device of a multipole with the features according to another aspect of the invention. Further, the invention solves this problem with a mass spectrometer with a multipole with the features according to a further aspect of the invention, with a mounting unit for positioning a holding device relative to a multipole with the features according to another aspect of the invention, and with a method for positioning a holding device relative to a multipole with the features according to a further aspect of the invention.

The invention is based on the finding that conventionally the attachment of an electrode device or a multipole, for example in a mass spectrometer, is preferably carried out by means of an annular holding device, arranged on the support elements of the electrode device, wherein the holding device is formed in two parts and arranged as a respective ring on the end sides of the multipole and surrounds the support elements in this case. Such a holding device has two circumferential, rotationally symmetrical supporting surfaces, which abut at least partially in the attachment of the multipole to a correspondingly corresponding receiving device, in particular in a mass spectrometer. However, such rotationally symmetric supporting surfaces do not allow high-precision positioning and alignment of the electrode device or multipole, for example within a mass spectrometer.

According to the invention, therefore, a multipole, for example a quadrupole, is provided with a holding device for holding, for example for holding the multipole in a mass spectrometer or on a mounting unit, whereby a high-precision alignment and positioning of the multipole is achieved in a particularly simple manner.

The holding device is constructed in one part or in several parts and is arranged on the multipole in order to attach the multipole to a receiving device for receiving the holding device. For this purpose, the holding device has one or more planar supporting surfaces which correspondingly correspond to the receiving device. Thereby, the holding device is attached to surfaces of the multipole that are manufactured together with electrodes of the multipole in one work step. Preferably, these surfaces and electrodes are grounded together with the same grindstone. The surfaces for attaching and thus fastening the holding device to the multipole thus have a clear and exact geometric reference to the highly precisely machined electrode surfaces. This ensures that the electrode surfaces, in particular their center, can be aligned exactly with the holding device. Thus, the multipole can also be precisely aligned within a mass spectrometer.

Further, the holding device is arranged on the multipole in such a way, that the one or more planar supporting surfaces are arranged rotationally asymmetric relative to the central longitudinal axis of the multipole.

Preferably, each planar supporting surface lies in a plane which runs parallel to the central longitudinal axis of the multipole, and is manufactured with high precision. As a result, advantageously, the mounting position of the multipole is precisely defined on the receiving device and the multipole is determined in its angular position in relation to the central longitudinal axis of the multipole. This enables a high-precision alignment of the central longitudinal axis of the multipole to a desired axis of a mounting unit or a mass spectrometer, such as for example a connecting axis between a source, for example ion source or electron source, and a detector or to an axis of a plurality of successively arranged ion optical or electron optical components, such as ion-optical or electron-optical lenses or filters, and thus enables a high-precision positioning of the multipole to a desired position in the mass spectrometer or mounting unit.

In addition, the invention enables a simplified installation and removal of the multipole, for example in a mass spectrometer, since, due to the planar supporting surfaces of the holding device, at least in relation to the angular position of the multipole relative to the central longitudinal axis of the multipole, only two attachment positions of the multipole on the receiving device are possible. In the case of maintenance or repair, this leads to a reduced expenditure of time and thus to correspondingly lower costs. In addition, due to this simplification the risk of damage or mispositioning and misalignment of the multipole during maintenance or repair work can be reduced. For example, the holding device can also be used as a holder or handle for the multipole, for example, due to the design features and embodiments described below.

The inventive rotationally asymmetric configuration of the supporting surfaces of the holding device determines, in contrast to the rotationally symmetrical configuration of the supporting surfaces according to the prior art, the angular position of the multipole relative to the central longitudinal axis of the multipole in its attached state, which advantageously—after an installation and removal of the multipole in a mass spectrometer—simplifies the calibration of the measuring system and generates reproducible measurement values of the mass spectrometer.

According to an embodiment of the invention, the holding device is arranged laterally of the multipole in the region of a cylindrical surface covering the multipole. This has the advantage that the planar supporting surfaces can be machined in the longitudinal direction of the multipole and can in particular be ground with high precision.

Advantageously, this machining of the planar supporting surfaces of the holding device is carried out in one grinding operation together with the electrodes and mounting surfaces of the support elements of the multipole. This advantageously ensures a highly precise alignment of the planar supporting surfaces of the holding device with respect to the electrode surfaces.

According to a further improvement of the invention, the holding device is arranged in a central portion of the covering cylindrical surface, wherein this central portion is arranged symmetrically to the central transverse axis of the multipole and corresponds to a maximum of 90% of the cylindrical surface. Advantageously, the holding device is formed in two parts, wherein in each case a part of the holding device is arranged on each side of a cutting plane through the central longitudinal axis of the multipole, in particular centrally or symmetrically to the central transverse axis of the multipole. Such an arrangement of the holding device advantageously ensures a particularly high stability of the attachment of the multipole, in particular in the case of vibrations or oscillations, for example in a mass spectrometer or on a mounting unit.

The arrangement of the holding device within the central portion essentially describes the arrangement with the omission of the end faces of the multipole. The lateral arrangement of the holding device outside the end faces of the multipole advantageously allows to axially receive the multipole in a mass spectrometer, i.e. a reception parallel to the system axis of the mass spectrometer, whereby the multipole can be particularly easily inserted and/or removed from above into or from a mass spectrometer.

According to a further improvement of the invention, the holding device has one or more positioning means with which the holding device can be aligned on a receiving device. These positioning means are manufactured with high precision, in particular with a shape tolerance and/or position tolerance from IT5 to IT11 in accordance with the ISO basic tolerances. This makes it advantageously possible to achieve in the installed state of the multipole, for example into a mass spectrometer, by means of the supporting surfaces and the positioning means an exact geometric position in all axial directions of the multipole and relative to other components of the mass spectrometer. Particularly preferably, the positioning means are manufactured with ISO basic tolerances IT6 to IT8.

The International Standard Organization (ISO) defines basic tolerances with the abbreviation IT for nominal dimensions of 1-500 mm as follows:

| Basic | Nominal dimension in mm | | | | | | | | | | | | |
|---|---|---|---|---|---|---|---|---|---|---|---|---|---|
| tolerances IT | 1-2 | >3-6 | >6-10 | >10-18 | >18-30 | >30-50 | >50-80 | >80-120 | >120-180 | >180-250 | >250-315 | >315-400 | >400-500 |
| | Tolerances in μm | | | | | | | | | | | | |
| 5 | 4 | 5 | 6 | 8 | 9 | 11 | 13 | 15 | 18 | 20 | 23 | 25 | 27 |
| 6 | 6 | 8 | 9 | 11 | 13 | 16 | 19 | 22 | 25 | 29 | 32 | 36 | 40 |

-continued

| Basic tolerances IT | Nominal dimension in mm | | | | | | | | | | | | |
|---|---|---|---|---|---|---|---|---|---|---|---|---|---|
| | 1-2 | >3-6 | >6-10 | >10-18 | >18-30 | >30-50 | >50-80 | >80-120 | >120-180 | >180-250 | >250-315 | >315-400 | >400-500 |
| | Tolerances in μm | | | | | | | | | | | | |
| 7 | 10 | 12 | 15 | 18 | 21 | 25 | 30 | 35 | 40 | 46 | 52 | 57 | 63 |
| 8 | 14 | 18 | 22 | 27 | 33 | 39 | 46 | 54 | 63 | 72 | 81 | 89 | 97 |
| 9 | 25 | 30 | 36 | 43 | 52 | 62 | 74 | 87 | 100 | 115 | 130 | 140 | 155 |
| 10 | 40 | 48 | 58 | 70 | 84 | 100 | 120 | 140 | 160 | 185 | 210 | 230 | 250 |
| 11 | 60 | 75 | 90 | 110 | 130 | 160 | 190 | 220 | 250 | 290 | 320 | 360 | 400 |

Advantageously, the planar supporting surfaces of the holding device are also manufactured with high precision, so that together with a highly precise manufactured receiving device as a perfectly fitting counterpart a high-precision alignment of the multipole in its geometric position is enabled.

Advantageously, planar supporting surfaces are arranged on two opposite sides of the holding device, which are manufactured with high precision plane-parallel to each other with a shape tolerance and/or position tolerance of IT5 to IT11 according to the ISO basic tolerances. Furthermore, the thickness of the holding device or the height between the plane-parallel supporting surfaces is highly accurate manufactured, in particular with a shape tolerance and/or position tolerance of IT5 to IT11 according to the ISO basic tolerances.

In the attached state of the multipole at least one planar supporting surface abuts on the receiving device while the opposite plane-parallel supporting surface of the holding device does not abut on the receiving device. The two plane-parallel opposite supporting surfaces advantageously allow a multi-part holding device made of identical manufactured parts, in which it is not known before mounting, which of the planar supporting surfaces will rest on a receiving device.

The high-precision positioning means also provide accurate alignment of the multipole in the longitudinal direction of the multipole relative to a connection axis between the source, for example ion source or electron source, and the detector or to an axis of several successively arranged ion optical or electron optical components, which is of great importance for a high analytical accuracy of the mass spectrometer.

The invention has in fact recognized that for increasing higher measurement accuracies it is no longer sufficient to increase the precision of a multipole more and more, but—precisely because of the ever increasing precision of the multipole —measurement inaccuracies may result from the comparatively less precise attachment of the multipole in the mass spectrometer. The inventive precise attachment of the multipole in the mass spectrometer thus advantageously produces a further gain in measurement accuracy and a gain in sensitivity of the measuring system. The increase in the precision of the multipole thus also leads to an increase in the measurement accuracy and sensitivity of the measuring system, because a limitation of the measurement accuracy and sensitivity of the measuring system due to an insufficiently precise positioning and alignment of the multipole no longer exists.

As means of positioning any means are possible, which produce a high-precision positioning and alignment of the multipole on a receiving device, such as a hole or bore which enable with a corresponding fastener, for example dowel pin or dowel pin screw, high-precision positioning and alignment of the multipole, for example in relation to the optical axis of the mass spectrometer, which corresponds to the ideal beam path of the ions.

Further, in the inventive high-precision production of the holding device as positioning means, the shaping of the holding device is possible if it has mating surfaces which cooperate with a corresponding shaping or with mating surfaces on the receiving device.

An improvement of the invention provides that the holding device is connectable or is connected with positive locking with the receiving device by at least one positioning means, such as a hole and/or a bore in the holding device by means of a fastener suitable for the hole and/or bore, in particular by means of a dowel pin or dowel pin screw, in the radial direction of the fastener.

The arrangement of the hole and bore or the holes and holes of the holding device corresponds to the (geometric) arrangement of receiving holes in the receiving device, which are used to fit dowel pins or dowel pin screws, such that in an arrangement of the holding device on the receiving device, the holes and/or bores find a congruent counterpart in the mounting holes. The center axes of the holes and/or bores in the holding device are arranged congruent with the center axes of the receiving holes in the receiving device.

The dowel pins or dowel pin screws which connect the holding device and the receiving device are designed to fit the inner diameter of the holes and/or bores and to fit the outer diameter of the pins, in particular with shape tolerances and/or positional tolerances according to ISO basic tolerances IT5 to IT11. This embodiment is preferably a fit or for example a press fit or a plug connection. Thus, a fast and precise alignment of the multipole in a mass spectrometer is advantageously possible with the aid of the holding device.

The connection running through the holes and mounting holes is positively formed in the radial direction of the dowel pins or with the precisely ground collar of the dowel pin screws, so that the dowel pins and the holes thus serve as fitting holes. This ensures an advantageously accurate positioning of the holding device on the receiving device, wherein the accuracy depends on the selected manufacturing tolerances, but with a form tolerance and/or position tolerance of at least ISO basic tolerances IT5 to IT11, preferably with ISO basic tolerances IT6 to IT8.

The arrangement of holding device and receiving device advantageously forms a system for high-precision alignment or positioning of the multipole in a mass spectrometer or on a mounting unit.

According to an improvement of the invention, the multipole is attached to a holding device with at least one hole, which is designed as a slotted hole, wherein the width of the slotted hole is equal to the diameter of the correspondingly arranged receiving bore in the receiving device. Likewise, the diameter of the at least one bore in the holding device is equal to the width of the hole formed as a slotted hole. The diameters of the bores and the receiving bores are thus of equal size. The holding device is thus advantageously connected by the at least one bore and the at least one slot through pins of the same diameter in the receiving bores of the receiving device with the receiving device. The formation of the hole in the holding device as a slot thereby advantageously avoids tilting when connecting the holding device to the receiving device by means of the pins. Likewise, tilting is avoided if the pins already stuck in the receiving device and the holding device is placed on these pins.

According to an improvement of the invention, the holding device of the multipole is designed as a two-part device, which is arranged on in each case an electrode half-shell or a support element of the multipole preferably designed as a quadrupole. Both parts of the holding device, as well as the electrode half-shells of the quadrupole, are identical. However, the invention is not limited to a two-part device as a holding device. Rather, the holding device according to the invention may also be integrally formed and then preferably arranged in the installed state of the multipole vertically below the multipole to transmit as few vibrations to the multipole.

In a two-part embodiment of the holding device, according to an improvement of the invention, both parts each have a hole, which is preferably a slotted hole, and each have a fitting bore. According to this embodiment of the invention, the holding device thus has two holes and two holes and the receiving device preferably has four receiving bores, which are arranged such that the geometric arrangement of the receiving holes in the receiving device corresponds to the arrangement of holes and holes in the holding device. The diameters of the holes and the receiving holes have the same size and the hole in the holding device is preferably formed as a slot and has a width which is equal to the diameter of the receiving holes in the receiving device. The holding device is thus advantageously connected with the receiving device through the two holes and the two slotted holes by means of pins of same design in or through the receiving holes. These identically formed pins are preferably formed as dowel pins and each have the same length and the same diameter.

The equality of used parts for the holding device of a multipole according to the invention and a use of the same pins lead due to higher quantities of the same (construction) parts to advantageously low production costs. Likewise, the same design of parts of a device leads to a low diversity of the components, thereby advantageously simplifying the maintenance or repair of a corresponding device. This in turn leads to a reduction of costs and effort in case of maintenance or repair.

In an alternative improvement of the invention, a connection between the holding device and the receiving device can be produced by means of a dowel pin screw. For this purpose, the dowel pin screw comprises a high-precision ground collar, which advantageously has a shape tolerance and/or position tolerance according ISO basic tolerances IT5 to IT11 and fits through a corresponding hole of the holding device. Due to a direct attachment of the holding device to the receiving device by means of dowel pin screws, the additional holes, necessary for the high-precision alignment, as well as the associated dowel pins may be omitted.

In a further alternative improvement of the invention, a connection between the holding device and the receiving device can be produced by means of a feather key. This respectively only requires only one slot or a groove or milling in the holding device and in the receiving device. Thus, an alignment and positioning of the holding device on the receiving device is possible in an advantageous manner by means of only one connection, wherein this connection is made by means of a feather key through a slotted hole and in a groove. In this case, the slotted hole is designed in such a way that it has a contour that matches the shape of the feather key. This hole is either provided in the holding device or the receiving device. In the respective other device, a groove or milling is provided, which has a contour that matches the contour of the feather key.

According to a further improvement of the invention, the multipole is attached to a holding device which is connectable via roof-edge and prism connections with the multipole, whereby the multipole can be dismantled along its central longitudinal axis into at least two sections or two support elements, preferably two electrode half-shells, which can be joined together also via roof-edge and prism connections. Each roof-edge and prism connection has a roof edge structure and a prismatic structure on the electrode half-shells or a roof edge element on the holding device and a prism structure on the electrode half shell, which are designed in correspondence with each other by the roof edge structure or the roof edge element being roof-shaped and the prismatic structure being channel-shaped. The roof edge structures or roof edge elements are mutually aligned to each other and the prism structures are mutually aligned to each other, each with respect to a respective parallel to the central longitudinal axis of the multipole, and each roof edge structure or each roof edge element can be interlocked with a prism structure. The connecting elements or connecting surfaces of the sections of the multipole (roof edge structure and prism element) and the receiving surfaces of the holding device (roof edge element) are of similar channel-shape or roof-shape, so that they can be interlocked together and can be produced by the same tool. Therefore, the receiving surfaces or receiving elements of the holding device are constructed as roof edge elements in the same way as the roof edge structures of the electrode half shells and are formed corresponding to the prismatic structures of the electrode half shells.

The aligned channel-shaped/roof-shaped design of the prismatic structures, roof edge structures (connecting elements) and the roof edge elements (receiving elements) and their corresponding shape advantageously ensure guidance along the alignment axis. Decisive for this function is the alignment of the two forms roof edge and prism, whereby a movement transverse to the corresponding alignment axis, which is parallel to the central longitudinal axis of the multipole in this case, is thus prevented. The uniform design of the roof edge structures of the electrode half shell of the multipole and the roof edge elements of the holding device ensures an advantageous equal relative orientation of the multipole to the holding device with respect to this central longitudinal axis.

In order to achieve precise guidance over the guide surfaces in the context of manufacturing tolerances for shape and/or position, in particular ISO basic tolerances IT5 to IT11, particularly preferably IT6 to IT8, highly accurate machining of the roof edge structures and prismatic structures and of the roof edge element designed as guide surfaces is necessary. For an advantageous parallel alignment the roof edge elements of the holding device are processed simultaneously and in the same processing step and with the same tool as the electrode half shells. This advantageously minimizes or prevents a natural accumulation of errors in the manufacturing process, which are unavoidable due to the respective manufacturing tolerances of each machining and/or manufacturing process. Thus, the accuracy of the guidance is within the manufacturing tolerance of the corresponding tool used to manufacture the surfaces. When using a precision tool, therefore, a high precision of the product can be achieved. The simultaneous production leads to an advantageously fast and thus cost-effective production. In addition, the simultaneous production and the same design of the connecting and receiving surfaces lead in an advantageous manner to the fact that only one tool is needed, whereby the production costs and the production effort are also reduced.

In order to achieve a high precision and accuracy of these surfaces, grinding is advantageously. The machining by means of a grinding tool has the advantage that the machined surfaces have a very low roughness, which results in an advantageously minimal friction between the interlocked surfaces. In addition, by grinding a very precise machining can be carried out, enabling the desired high accuracy to be achieved.

According to a further improvement of the invention, the temperature expansion coefficient of the holding device is equal to the temperature expansion coefficient of the support elements or electrode half-shells of the multipole. The holding device and the electrode half-shells of the multipole are preferably made of metal, which has a temperature expansion coefficient that is as equal as possible within a material-specific tolerance. The material of the holding device is advantageously similar to the material of the electrode half-shells. The similarity of the two materials manifests itself in the fact that the temperature expansion coefficient of the holding device differs by a maximum of 5%, in particular 2.5%, preferably 1%, particularly preferably 0.1% from the temperature expansion coefficient of the electrode half-shells.

Advantageously, both materials have a low temperature expansion coefficient, so that thermally induced expansions of the material and thus changes in length of the work-piece are minimized. The similarity, in particular equality, of the material and of the thermal properties offers the advantage that any stresses at the connection surfaces of both devices that may, for example, cause relative displacements, are minimized, in particular prevented.

However, the invention is not limited to the use of equal temperature expansion coefficients. Rather, different temperature expansion coefficients are also possible for the support elements and the holding device of the multipole, if, for example for reasons of cost, the holding device is made of a more favorable material, for example V2A steel.

According to an improvement of the invention, the multipole is attached to a holding device with through holes and/or tapped holes, wherein the through holes and/or tapped holes of the holding device are arranged corresponding to through holes and/or tapped holes of a receiving device. Thus, an advantageous locking of the holding device to the receiving device by means of a screw connection using appropriate screws, in particular by means of thin shaft screws or dowel pin screws, can be ensured. This locking serves to fix the holding device perpendicular to the radial direction of the through holes and/or tapped holes. In the present case, this is a fixation along an axis, which is perpendicular to a plane which completely contains the central longitudinal axis of the multipole. Thus, the number of degrees of freedom or free directions of movement is reduced. In particular, the holding device preferably has two, in particular three, in particular four, through holes or tapped holes and the receiving device has through holes or tapped holes arranged correspondingly, in particular congruent, with respect to these through holes or tapped holes.

Preferably, a tapped hole corresponds to a respective through hole in order to fix the holding device to a receiving device by means of a screw. If tapped holes or partial tapped holes are provided both in the holding device and in the receiving device, the fixation is preferably carried out by means of suitable thin-shaft screws in which a part of the thread or the unthreaded region is turned off and which have a corresponding mating thread only in the region of the corresponding tapped hole. Such thin shaft screws are advantageously mounted in a loss-resistant manner.

In an alternative improvement of the invention, a locking of the holding device on the receiving device can also be realized by means of a clamping closure. Such a locking system preferably has a clamping hook and a counter hook, which may be designed as a bracket, clamp or lever.

In a further improvement of the invention, the multipole is attached to a holding device, which is non-detachably connected to at least one support element or at least one electrode half shell of the multipole and manufactured together with them. This can be achieved in particular by means of casting, milling from a material block or sintering. During casting, for example, a holding device is already provided in the casting mold for the electrode half-shell. Alternatively, an electrode half shell is welded as a semi-finished product or precursor with the holding device prior to further processing.

In the case of the multipole according to the invention, at least two, three or more of the improvements described above can be combined with one another in order to obtain meaningful feature combinations within the scope of the invention.

Furthermore, the above-mentioned problem is solved by means of a holding device of a multipole, in particular quadrupole, wherein the holding device can be arranged on a receiving device of a mass spectrometer, a mounting unit and/or a unit serving the maintenance or repair of the multipole. The holding device preferably has at least one roof edge structure and at least one prism structure for fastening the holding device to the multipole. The holding device according to the invention thus serves for the high-precision alignment, positioning and holding of the multipole, for example a quadrupole, for example in a mass spectrometer or on a mounting unit.

Furthermore, the above-mentioned problem is solved by means of a mass spectrometer with a multipole according to the present invention and with a receiving device for receiving the holding device of the multipole, wherein by means of the holding device of the multipole, the multipole can be preserved in an exact geometric position relative to all axial directions of the multipole and relative to other components of the mass spectrometer. As a result of the high-precision alignment and positioning of the high-precision manufactured components of the mass spectrometer to each other, the resolution, sensitivity and performance of the mass spectrometer can advantageously be increased overall in order to advantageously contribute to increasing the measuring accuracy of mass spectrometers.

Furthermore, the above-mentioned problem is solved by means of a mounting unit with a receiving device for positioning a holding device relative to the multipole, in particular quadrupole.

The mounting unit according to the invention with a receiving device for positioning a holding device relative to the multipole provides that the mounting unit has a bottom plate. This bottom plate is aligned perpendicular to the central longitudinal axis of the multipole arranged on the receiving device of the mounting unit and parallel to the effective direction of gravity. Such an embodiment of a mounting unit allows an advantageous precise positioning of the holding device relative to the multipole and the support elements or electrode half-shells of the multipole to each other. Thus, a precise alignment and holding of the multipole according to the invention by means of the holding device in a mass spectrometer is advantageously enabled.

Advantageously, in addition, an exact positioning of the electrodes to each other, in particular the beginning and end points of their sections, can be ensured, whereby disturbances of the electric field in the multipole are reduced.

According to an improvement of the invention, the mounting unit according to the invention comprises a rear wall, which has recesses, in particular hole-shaped recesses. Through these hole-shaped recesses there is a visual connection from the outside through the rear wall of the mounting unit on the fasteners of the holding device, preferably designed as screw fasteners, and the multipole and/or the electrode half-shells of the multipole. This visual connection ensures accessibility of the screw, in particular the screws, through these recesses, for example with a screwdriver.

Due to the use of the mounting unit for positioning the holding device relative to the multipole and the electrode half-shells of the multipole to each other, the mounting unit can also be referred to as a positioning unit.

The use of a mounting unit has the advantage that the holding device and the half-shells of the multipole can be mounted within this unit and thus can be aligned with one another. Thus, a calibration of the positioning of the holding device relative to the multipole is carried out and thus a prior alignment before the installation of the holding device and the multipole in the mass spectrometer. For this purpose, the mounting unit comprises a receiving device according to the invention, a bottom plate, which ensures an exact alignment of the electrodes to each other, and corresponding recesses, which allow the accessibility of screws. These screws are used to lock the precise positioning of the holding device relative to the multipole and possibly the electrode half-shells of the multipole to each other.

Thus, advantageously, an alignment and an accurate positioning of the holding device relative to the multipole prior to insertion or installation into the mass spectrometer are possible.

Figure 4:
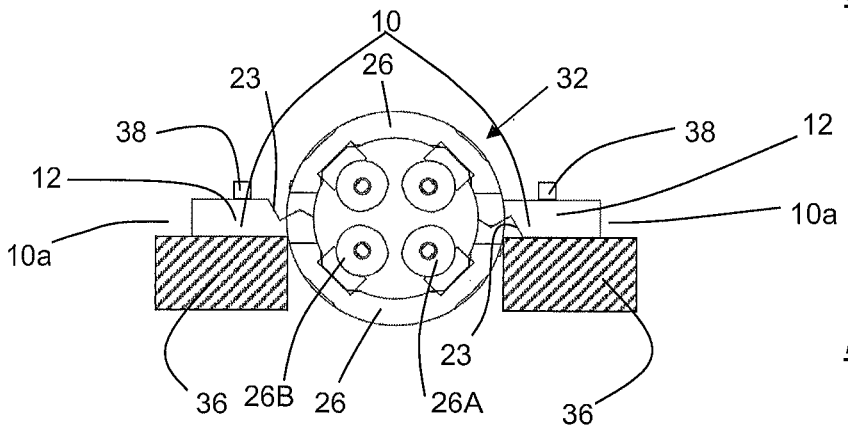
Figure 5:
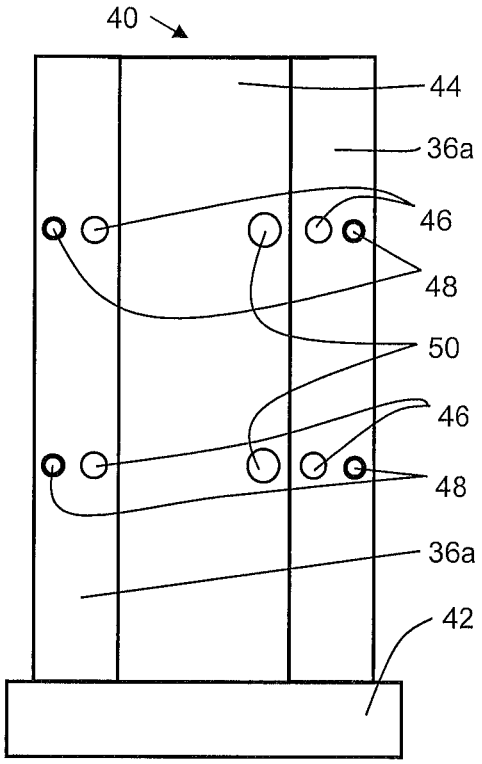
Figure 9:
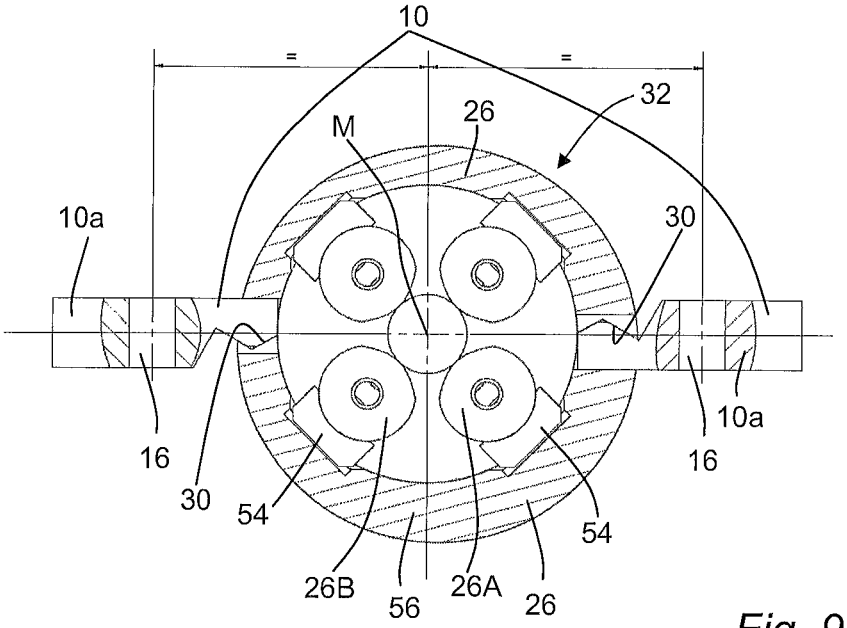
Figure 10:
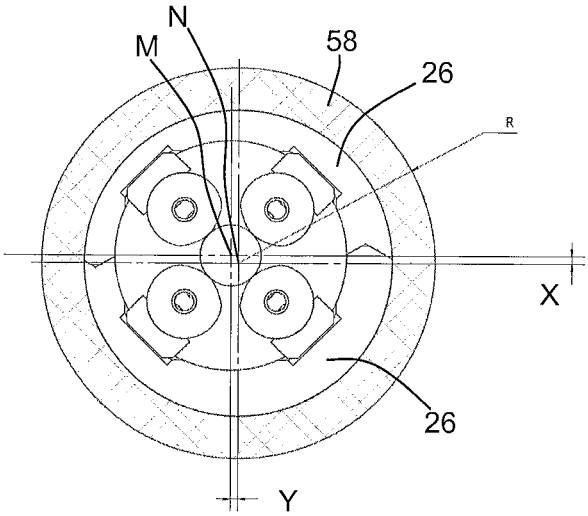

Further embodiments of the invention will become apparent from the claims and from the embodiments explained in more detail with reference to the drawing. In the drawing FIGS. 1*a-d* show a holding device of a multipole according to the invention from different perspectives, FIGS. 2*a-c* show an electrode half shell of a quadrupole together with a holding device from different perspectives, FIG. 3*a* shows a multipole comprising two electrode half-shells together with a holding device in a perspective view, FIG. 3*b* shows a multipole comprising two electrode half-shells together with a holding device in a side view along the central longitudinal axis of the multipole, FIG. 4 shows a side view of a multipole comprising two electrode half-shells together with a holding device on a receiving device, FIG. 5 shows a frontal view of an empty mounting unit without multipole and holding device, FIG. 6*a, b* show a side view and a frontal view of the mounting unit with multipole and holding device, FIGS. 7*a-d* show several embodiments of a holding device, FIGS. 8*a-d* show several embodiments of introduced into the fixture holes and holes, FIG. 9 shows the multipole according to FIG. 4 without the receiving device with exaggeratedly represented inaccurately worked outer contours of the electrode half-shells, and FIG. 10 shows the multipole according to FIG. 9 without the inventive holding device depicted in FIG. 9, however, with a conventional annular holding device for illustrating an undesirable offset of the common centre of the electrodes of the multipole with respect to the centre of the outer contour of the electrode half-shells.

Like reference numerals in the figures indicate like parts. Further letters behind a reference numeral designate further exemplary embodiments of the corresponding part.

Figure 3A:
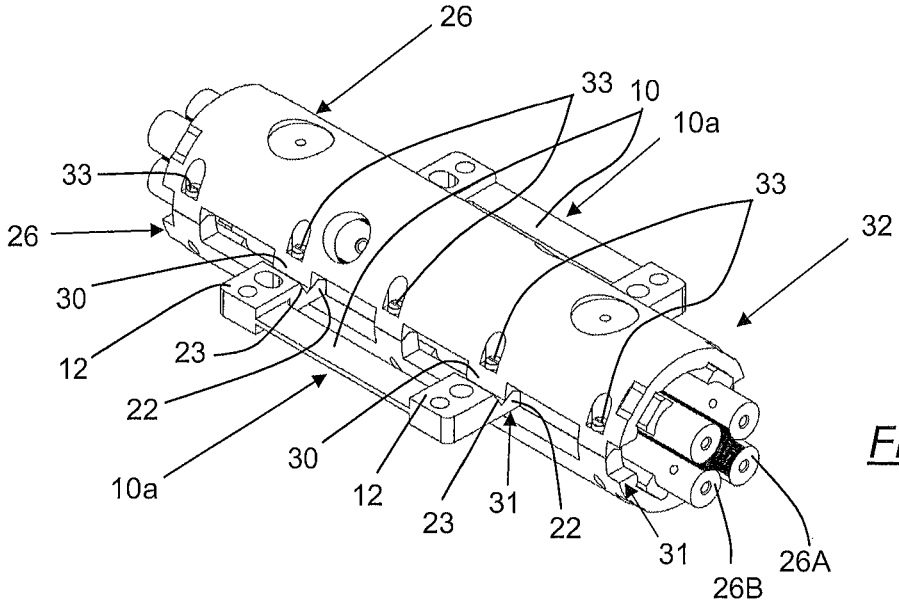
Figure 3B:
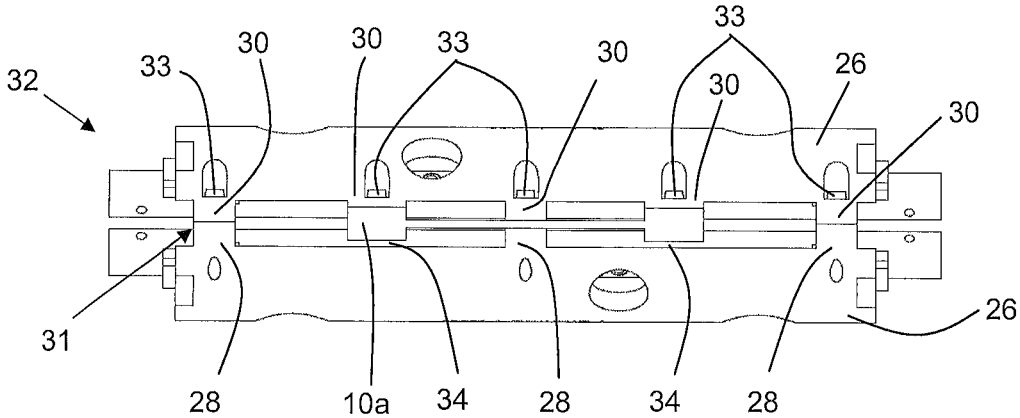

FIGS. 1*a-d* show a possible embodiment of a holding device 10 of a multipole according to the invention, as shown for example in FIG. 3*a* by the reference numeral 32. In FIGS. 1*a-d*, however, only one part 10*a* of the two-part holding device 10 is shown.

Figure 2A:
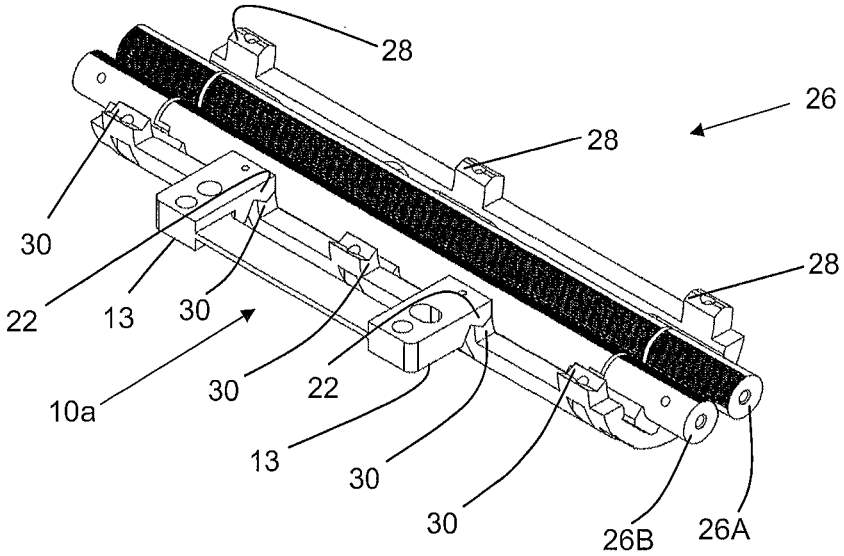
Figure 2B:
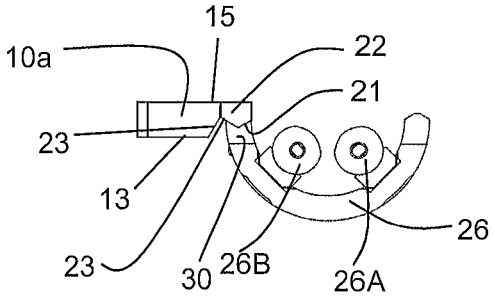
Figure 2C:
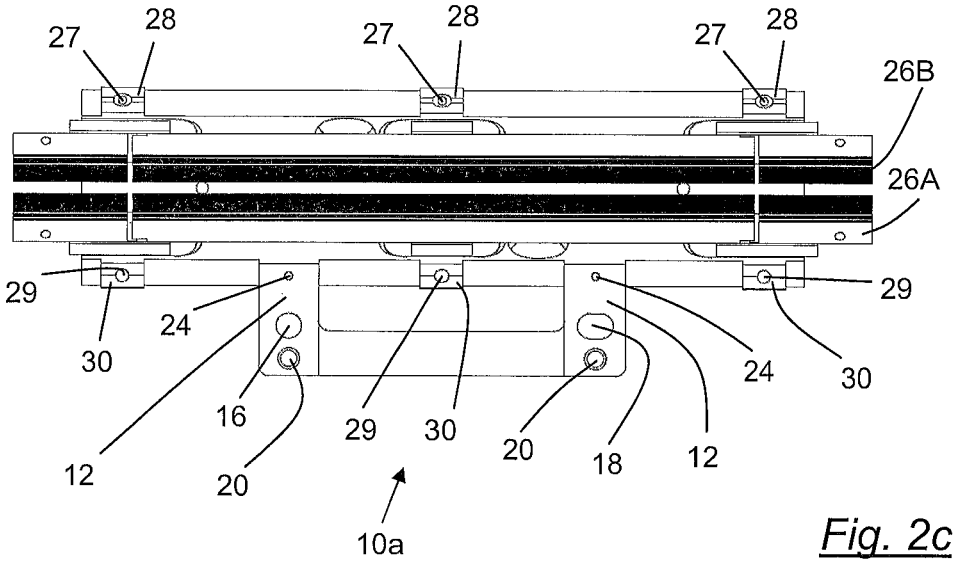

FIG. 1*a* shows a particularly preferred embodiment of the holding device 10*a* in a perspective view. It describes a U-shape, wherein two supports 12 form the mutually parallel sides of the U-shape and a support connection 14 forms the lower part of the U-shape, which connects the parallel sides of the U-shape and thus the supports 12. The supports 12 each comprise as positioning means a bore 16 and a hole 18 and two through and/or tapped holes 20.

The surfaces of the supports 12 have a first support surface 13 and a second support surface 15, which are formed as a high-precision machined, planar surface plane-parallel to each other. These supporting surfaces 13, 15 are preferably manufactured with respect to their nominal dimensions according to ISO basic tolerances IT5 to IT11. Furthermore, these supporting surfaces 13, 15 also have high-precision positional tolerances with respect to the parallelism of the two supporting surfaces 13 and 15 with respect to one another and with respect to the perpendicularity between the supporting surfaces 13, 15 and the positioning means.

The bore 16 is formed in this embodiment as a bore which serves a later accurate positioning of the holding device 10*a*. The bore 16 preferably has a corresponding counterpart located in a further component, on which the holding device 10*a* is to be aligned and positioned, so that a pin form-fitting in the radial direction of the bore 16 matching in the bore 16 can be inserted through the bore 16 and the corresponding counterpart.

The hole 18 is formed in this preferred embodiment as a slotted hole having the same width as the diameter of the bore 16. The through and/or tapped holes 20 are used to attach the holding device 10*a* to another component.

The preferred holding device 10*a* also has roof edge elements 22 with roof edge tapped holes 24. Each roof edge element 22 has two mutually angled surfaces, a narrow roof edge 21 and a broad roof edge 23, each with the same pitch. These roof edge flanks 21 and 23 are highly precisely manufactured, preferably by grinding. Via a preferably angularly arranged side surface 19, the surface of the angularly arranged roof edge 23, which is wider than the narrower edge of the roof edge 21, comprises a connection with the first supporting surface 13 of the holding device 10*a*.

Figure 1B:
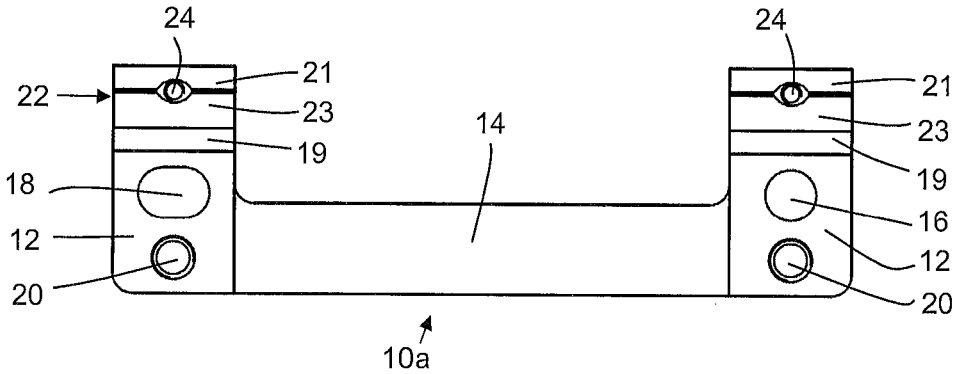

FIG. 1*b* shows a side view of the same preferred embodiment of the holding device 10*a* as in FIG. 1*a*. This illustration highlights the formation of the bore 16, formed as a slotted hole 18, the through and/or tapped holes 20 and the roof edge tapped holes 24. The mutually angled roof edge flanks 21 and 23 form the roof edge element 22. The roof edge element 22 has a roof edge tapped hole 24, by means of which the holding device 10*a* can be fastened to a corresponding further device by means of screws.

Figure 1C:
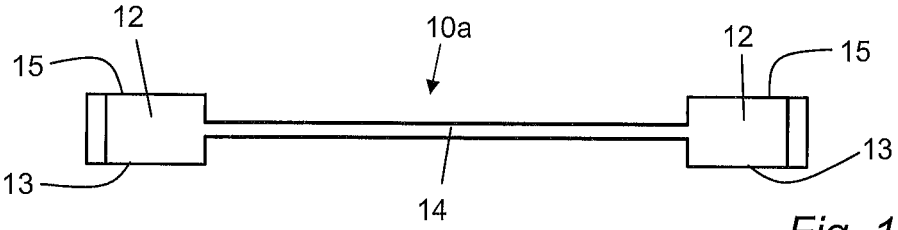

FIG. 1*c* shows a side view of the longitudinal side of the same holding device 10*a* as in FIGS. 1*a, b*. This illustration shows that the height or thickness of the supports 12 is a multiple of the height or thickness of the support connection 14. The height or thickness of a support 12 is defined by the distance of the first support surface 13 to the second support surface 15 of the holding device 10*a*.

The different thickness of the support connection 14 compared to the supports 12 is used advantageously for material savings. Furthermore, the small thickness of the overlay connection 14 advantageously allows, to some extent, the absorption of torsional movements. The support connection 14 serves to hold the supports 12 at a predetermined distance and a predetermined position to each other. The support surfaces 13 and 15 of the supports 12 are formed exactly parallel to one another, so that these surfaces must be precisely machined. The production of these surfaces is preferably carried out by means of milling and/or grinding.

Figure 1D:
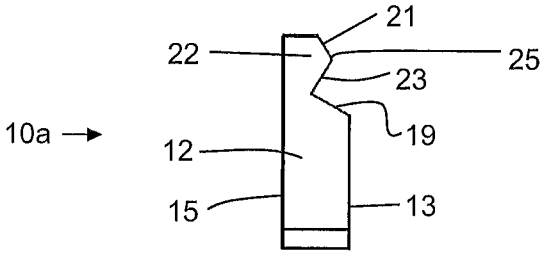

FIG. 1*d* shows a side view transverse to the longitudinal direction of the same preferred holding device 10*a* as in FIGS. 1*a-c*. Here it can be seen that the supports 12 are formed thicker than the height of the roof edge element 22, wherein the height of the roof edge element 22 is determined by the distance of the support surface 15 to the vertex 25 of the roof-shaped side of the roof edge 22. The mutually angled roof edge shoulders 21 and 23 have a predetermined angle and an axis of symmetry, wherein the axis of symmetry extends through the vertex 25 of the roof edge shape. This angle between the symmetry axis of each one of the roof edge flanks 21 and 23 of the roof wall element 22 is preferably 120°, in particular 110°, in particular 130°.

The holding device according to the invention according to FIGS. 1*a-d* is preferably made of one work-piece. This manufacture is preferably carried out by means of milling. Surfaces which require a precise machining with high accuracy and/or a low roughness of the surface are further processed by grinding.

FIG. 2*a* shows a perspective view of a support element or an electrode half-shell 26 of a multipole with two electrodes arranged on the electrode half-shell 26. The blackened surfaces represent essentially hyperbolically shaped surfaces of these electrodes, which surfaces determine the field profile within the quadrupole.

Furthermore, FIG. 2*a* shows a holding device 10*a*, which is arranged on a support element or an electrode half-shell 26 of a multipole. As in FIGS. 1*a-d*, FIG. 2*a* shows a preferred embodiment of the holding device 10. Other embodiments of the holding device 10 are also applicable to the following explanations.

The half-shell electrode 26 has connecting elements, which are formed as a roof edge structure 28 and prism structure 30. The roof edge structures 28 and prismatic structures 30, as well as the roof edge element 22 of the holding device 10*a* in FIGS. 1*a-d*, have two surfaces arranged at an angle to one another, each with the same pitch. On one side of the electrode half shell 26 only roof edge structures 28 are arranged and on the other, opposite side of the electrode half-shell 26 only prism structures 30 are arranged. The roof edge structures 28 and prism structures 30 are formed corresponding to one another in such a way that in each case a roof edge structure 28 and a prism structure 30 can be joined to one another to form a roof edge and prismatic connections 31. The prismatic structures 30 have a channel-shaped or convex shape. The number of prism structures 30 is the sum of the number of fabricated roof edge structures 28 and the number of roof edge elements 22 of a holding device 10*a* to be fastened to the electrode half-shell 26. The roof edge and prismatic connections 31 thus serve on the one hand the joining of two electrode half-shells 26 to a multipole and on the other hand the fastening of a holding device 10*a* to an electrode half shell 26, wherein each roof edge element 22 of the holding device 10*a* is interlocked to a prism structure 30. The attachment of the holding device 10*a* to the electrode half-shell 26 via a roof edge and prism connections 31 advantageously allows a μm accurate positioning of the holding device 10*a* to the center of the multipole, or to the central longitudinal axis of the multipole and thus a precise positioning of the multipole within a mass spectrometer.

FIG. 2*b* shows a side view of the electrode half-shell 26 with the preferred holding device 10*a*. The roof edge element 22 of the holding device 10*a* can be inserted into the prism structure 30 of the electrode half-shell 26 due to its shape corresponding to the prism structure 30. According to the invention, the wide roof edge 23 of the roof edge element 22 is oriented in the direction of the support surface 13 and is designed wider than the narrow roof edge 21 of the roof edge element 22. This results in the roof edge 23 protruding beyond the outside of the electrode half-shell 26 after the roof edge element 22 of the holding device 10*a* is fitted into the prism structures 30 of the electrode half shell 26. This has the advantage that tilting of the roof edge element 22 on the prism structure 30 and thus of the holding device 10*a* on the electrode half-shell 26 is prevented.

FIG. 2*c* shows a plan view of an electrode half-shell 26 with the electrodes attached to the electrode half-shell 26 and a holding device 10*a* in the same embodiment as in FIGS. 2*a* and 2*b*. Again, as shown in FIG. 2*a*, the substantially hyperbolic surfaces of the electrodes are shown in black.

The supports 12 of the holding device 10*a* cover in this plan view the two further prismatic structures 30, which serve to secure the holding device 10*a*. Thus, in each case the same number of roof edge structures 28 and prismatic structures 30 is visible. The holding device 10*a* can be fastened by means of screws through connecting bores 29 in the prismatic structures 30 by means of the roof-edge tapped holes 24 in the holding device 10*a* on the electrode half-shell 26. The roof edge structures 28 of the electrode half-shell 26 have connecting tapped holes 27 which are preferably of the same design as the roof-edge tapped holes 24 of the holding device 10*a*.

FIG. 3*a* shows two electrode half-shells 26, which are joined together to form a multipole 32, each electrode half-shell 26 having a holding device 10*a* according to the embodiment of FIGS. 2*a-c*. Such a multipole 32 is preferably designed as a quadrupole. FIG. 3*a* shows such a preferred quadrupole, which comprises two of the half-shells 26, attached to a two-part holding device 10*a*. Each part of the holding device 10*a* is arranged and fastened to prism structures 30 laterally to an electrode half-shell 26 via the roof edge elements 22. The electrode half-shells 26 are connected to each other via the roof edge structures 28 and the prism structures 30, wherein each roof edge structure 28 is joined into a prism structure 30. Attached to each other, a roof edge structure 28 with a prismatic structure 30 forms a roof edge and prismatic connection 31. The roof edge and prismatic connections 31 can be fixed by means of screws 33. Compared to the narrow roof edges 21, the wider constitution of the roof edge 23 serves advantageously to ensure a defined distance of the supporting surfaces 13 of the supports 12 to the roof edge and prismatic connections 31.

FIG. 3*b* shows a side view along the central longitudinal axis of the electrode half-shells 26 assembled to form a multipole 32, each having a holding device 10*a*, as in FIG. 3*a*. The side view shows the joints formed as roof edge and prismatic connection 31 of the mounted electrode half-shells 26. Thus, in this view, only one of the two fasteners 10*a* fixed visible. The second holding device 10*a* is located just behind the holding device 10*a* visible in FIG. 3*b*. Each of the connections of a roof edge structure 28 and a prism structure 30, which are joined together to form a roof edge and prism connection 31, is fixed with one screw 33 each. For this purpose, a connecting bore 29 is made into each prism structure 30 and a connecting tapped hole 27 is made into each roof edge structure 28. These connecting tapped holes 27 of the electrode half-shell 26 are preferably designed in the same way as the roof edge tapped holes 24 of the holding device 10*a*. Thus, in an advantageous manner, the holding device 10*a* can be fixed by means of the same screws 33 via the prismatic structures 30 to the electrode half-shells 26 as the electrode half-shells 26 with one another.

The holding device 10*a* fastened to the electrode half-shell 26 has a mounting spacing 34 relative to the respective other electrode half-shell. As a result, the holding device 10*a* can also be connected to the prism structures 30 after the electrode half-shells 26 have been joined together, the holding device 10*a* being inserted into the prism structures 30 by means of lateral insertion along the alignment of the roof edge elements 22, which are aligned parallel to the longitudinal direction of the multipole 32.

Preferably, the holding device 10*a* has at least one roof edge structure 28, which can be connected to a correspondingly formed prism structure 30 of the electrode half-shell 26. Thus, the reception of a holding device 10 can be produced advantageously by means of already known and existing tools for the manufacture and processing of the electrode half-shells 26.

FIG. 4 shows a multipole 32 with a two-part holding device 10*a*, which is arranged on a receiving device 36. The holding device 10*a* and thus the multipole 32 is connected by means of fastening elements 38, in particular dowel pins, with the receiving device 36. Such a receiving device 36 is, for example, arranged in a mass spectrometer.

This view, shown in FIG. 4, on the end face of the multipole 32 shows the arrangement according to the invention of the holding device 10*a* in the receiving device 36, which is characterized by the following features:

The holding device 10*a* is arranged laterally of the multipole 32 in the area of a cylindrical surface surrounding the multipole 32, wherein the vertical extent or thickness of the supports 12 of the holding device 10*a* is advantageously dimensioned such that a plane containing a straight line passing through the center of the circular cross section of the multipole 32, is a plane of symmetry of the cylindrical shape of the preferred multipole 32 in FIG. 4, and is dividing the holding device 10*a* into two parts of the same vertical extent or thickness. Due to the advantageous embodiment and arrangement of the holding device 10*a* on the multipole 32, in which the planar supporting surfaces 13, 15 of the supports 12 are rotationally asymmetric to the central longitudinal axis of the multipole 32, it is ensured that the multipole 32 is aligned parallel to a plane defined by the supported surfaces of the supports 12 of the holding device 10*a*. The supports 12 of the holding device 10*a* may be arranged on or in a corresponding receiving device 36.

FIG. 5 shows a front view of a preferred mounting unit 40. The mounting unit 40 preferably has a bottom plate 42, a rear wall 44 and a receiving device 36*a* for a holding device 10*a*. Such a mounting unit 40 is used to mount the holding devices 10*a* according to FIGS. 1*a-d*, 2*a-c* and 3*a-b* to a multipole 32 and possibly the electrode half-shells 26 to each other.

The receiving device 36*a* according to the embodiment shown has four receiving holes 46 and four receiving tapped holes 48. The receiving holes 46 and the receiving tapped holes 48 of the receiving device 36*a* are arranged such that they correspond to the arrangement of the bores 16, holes 18 and through and/or tapped holes 20 of the holding device 10*a*. In addition, the diameters of the holes 16 in the holding device 10*a* and the receiving holes 46 in the mounting unit 40 and the diameter of the through and/or tapped holes 20 in the holding device 10*a* and the receiving tapped holes 48 in the mounting unit 40 are of the same size. The rear wall 44 has advantageously recesses 50, which allow the introduction of a tool, preferably a screwdriver.

Figure 6A:
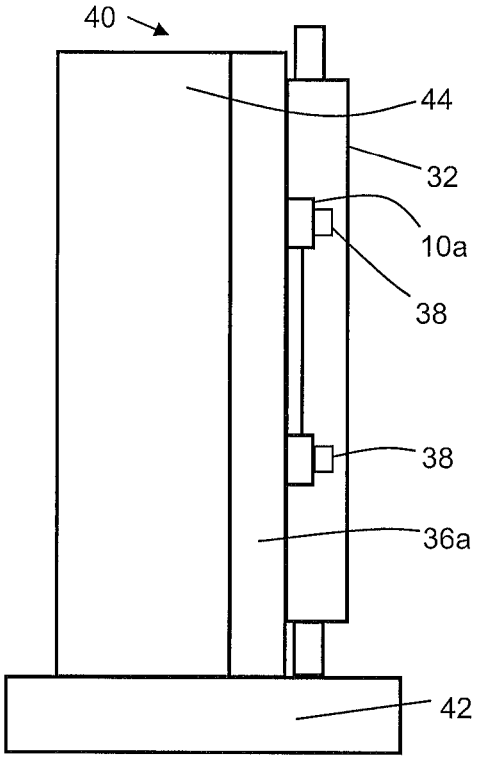

FIG. 6*a* shows a side view of the preferred mounting unit 40 according to FIG. 5 with a multipole 32 and a holding device 10*a*. The holding device 10*a* is connected to the receiving device 36*a* by means of at least two, preferably four, pins 38. This connection of the pins 38 through the bores 16 in the holding device 10*a* and the receiving holes 46 of the receiving device 36*a* is formed in a form-fitting or positive manner in the radial direction of the pins 38. Preferably for producing such a positive connection correspondingly formed dowel pins are used, which extend through the holes formed as fitting bore holes 16 in the holding device 10*a* and the receiving holes 46 in the receiving device 36*a*.

Figure 6B:
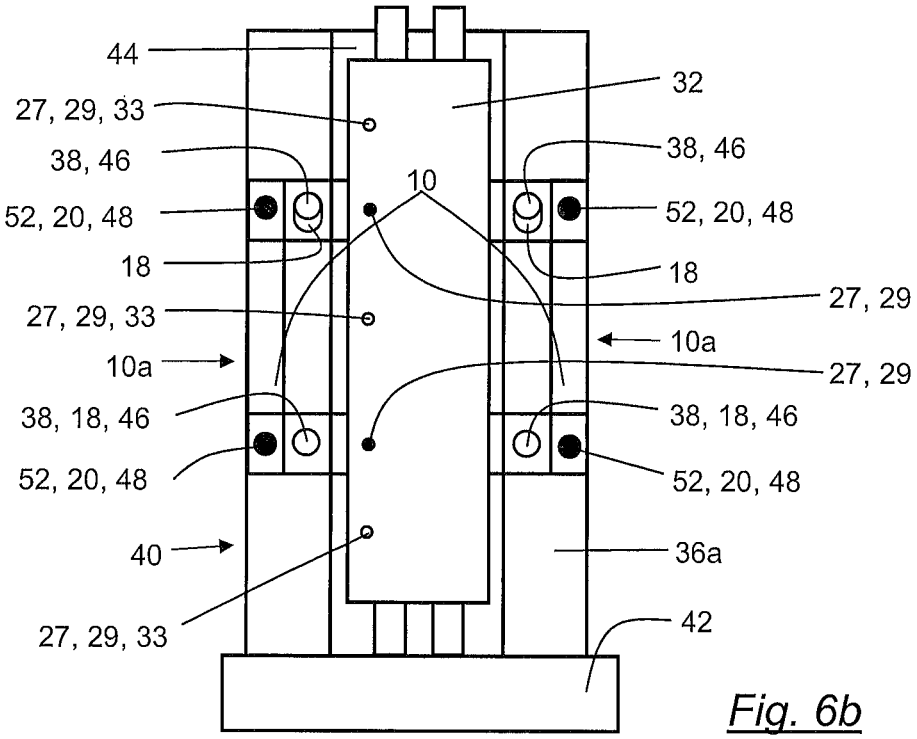

FIG. 6*b* shows a frontal view of the same structure as in FIG. 6*a*, which has a mounting unit 40 with a receiving device 36*a*, a bottom plate 42, a rear wall 44 with recesses 50 and a multipole 32 with a holding device 10*a*, which is arranged on the mounting unit 40 by means of suitably designed pins 38. Recesses 50 are not visible due to the arrangement of the multipole 32 in the mounting unit 40 in this view, shown in FIG. 6*b*. The holes 18 formed in the holding device 10*a* as slotted holes advantageously enable a locking or arrangement of the holding device 10*a* on the receiving device 36*a*, without any tilting. The mounting unit 40 allows the positioning of the holding device 10*a* relative to the multipole 32. The procedure is as follows:

The electrode half-shells 26 are already loosely connected to one another and to the holding device 10*a*. By means of at least two pins 38, the holding device 10*a* is connected to the receiving device 36*a* by a respective hole 18 and a bore 16. To fix this connection fixing screws 52 can be introduced into the through and/or tapped holes 20 of the holding device 10*a* and the through and/or receiving tapped holes 48 in the receiving device 36*a* of the mounting unit 40.

Preferably, this fixing is carried out via a through hole 20 each with a corresponding tapped hole 48 by means of a fixing screw 52. For fixing via a respective tapped hole 20 or a partial tapped hole with a corresponding receiving tapped hole 48, a thin shaft screw is used as a fixing screw 52 with a partial thread, which has a thread only in the area of the receiving tapped hole 48.

After reaching a predetermined relative position of the holding device 10*a* to the multipole 32, it is fixed accordingly. This fixation takes place in this preferred embodiment by means of screws 33. For this purpose, the screws 33 are inserted through the connecting bores 29 of the electrode half shells 26 into the connection tapped holes 27 of the electrode half-shells 26 for fixing the electrode half shells 26 to one another.

To fix the holding device 10*a* on the half-shell electrode 26, the screws 33 are inserted through the connecting holes 29 of the electrode half-shells 26 in the roof edge tapped holes 24 of the holding device 10*a*. After carrying out the fixation, the desired positioning of the holding device 10*a* with respect to the multipole 32 is completed. Thus, the multipole 32 is aligned by means of the holding device 10*a* according to the invention in a predetermined position in the mass spectrometer and quickly and easily installed in the mass spectrometer.

Figure 7A:
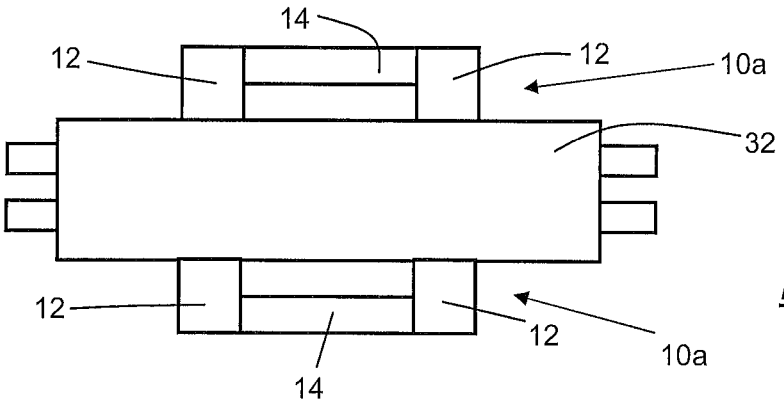

FIGS. 7*a-d* show various embodiments of a holding device 10 according to the invention on a multipole 32, the list of embodiments not being conclusive:

FIG. 7*a* shows a multipole 32 with a two-part holding device 10*a* of the preferred embodiment, as shown in the previous FIGS. 1*a-d*, 2*a-c*, 3*a-b*, 4 and 6*a-b*. Each of the two parts of the holding device 10*a* is preferably made of one respective work-piece, in particular milled. The holding device 10*a* describes a U-shape, wherein the mutually parallel portions of the U-shape form the supports 12, which are connected to each other by means of a support connection 14 and in a fixed relative position.

The supports 12 are thicker than the support connections 14. The supports 12 are made such that they provide high-precision, planar supporting surfaces 13 and 15. This requires a precise production of the surfaces of the supporting surfaces 13 and 15 of the supports 12 with respect to the form tolerances and/or position tolerances, in particular with an ISO basic tolerance of IT5 to IT11.

In a preferred embodiment, the surfaces of the supporting surfaces 13 and 15 are machined by means of machining processes, for example sawing and milling. In order to meet the requirement of high precision in production, machining by means of milling is preferably selected for the supporting surfaces 13 and 15. The processing of the support connections 14 requires compared to the support surfaces 13 and 15 a lower precision, since these serve primarily to ensure and define a fixed axial distance and a desired position of the supports 12 to each other.

Figure 7B:
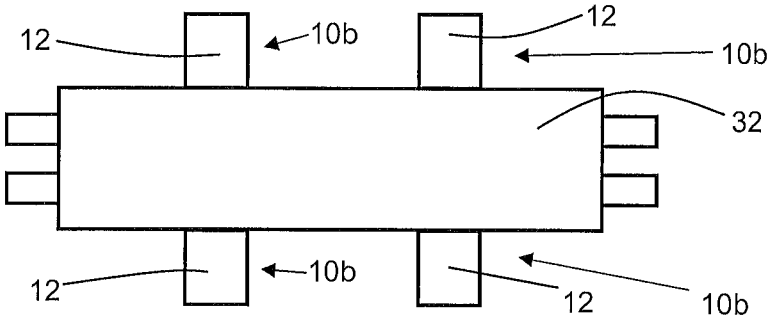

FIG. 7*b* shows a holding device 10*b* for holding a multipole 32 with a total of four, preferably identical, parts. Such a holding device 10*b* has no support connection 14 compared to a holding device 10*a*. The holding device 10*b* comprises four supports 12 without a support connection 14. This embodiment has the advantage that at least four of the parts of the holding devices 10*b* can be produced from a material piece of the same size as the material piece from which two of the parts of the holding devices 10*a* were manufactured. This leads to an advantageous material saving of 50-70% and thus also to a reduction of the work effort.

Figure 7C:
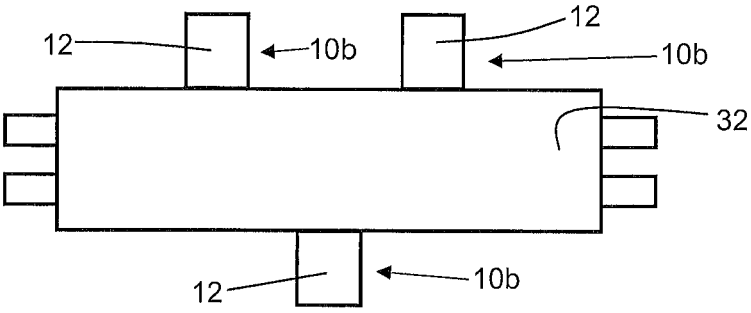

FIG. 7*c* shows another embodiment of a holding device 10 according to the invention for holding a multipole 32. In this case, the multipole 32 is connected to three parts of the holding device 10*b*, whereby further material savings with a guarantee of a stable position of the multipole 32 is achieved. However, this material saving has the consequence that the arrangement of the supports is not symmetrical with respect to an axis of symmetry which runs parallel to the central longitudinal axis of the multipole 32. Thus, the electrode half shells 26 of the multipole 32 would each have a different number of roof edge and prism connections 31.

Figure 7D:
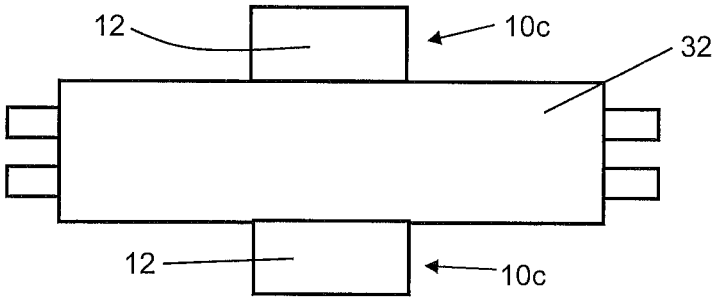

FIG. 7*d* shows a further embodiment of the holding device 10 according to the invention. In this case, the multipole 32 has two identically formed parts of a holding device 10*c*, which does not comprise any support connections 14. The parts of the holding device 10*c* are aligned centrally along the central longitudinal axis of the multipole 32 and fixed to the electrode half-shells 26. The width or size of the supports 12 of the holding device 10*c* is designed such that in each case for a stable position a sufficient supporting surface 13 and 15 is ensured. However, this embodiment of the holding device 10*c* requires a very high precision in the manufacture of the supporting surfaces 13 and 15, which results in higher production costs.

As an alternative to the embodiments according to FIGS. 7*a-d*, a one-part use of a holding device 10 according to one of the embodiments 10*a-c* is also possible. When mounted with only a one-piece holding device 10, this holding device 10*a-c* is preferably arranged in the installed position of the multipole 32 in a mass spectrometer vertically below the multipole 32 in the direction of the central longitudinal axis of the multipole 32, in order to transfer as little vibrations or oscillations as possible on the multipole 32.

FIGS. 8*a-d* show several embodiments of the bores 16, holes 18 and through holes and/or tapped holes 20, which are introduced into the preferred embodiment of the holding device 10*a* of FIGS. 1*a-d*. The corresponding variants of the embodiments are identified by the addition of dashes to the reference numeral 10*a*: for example 'for the first alternative variant," for the second alternative variant, etc.

Figure 8A:
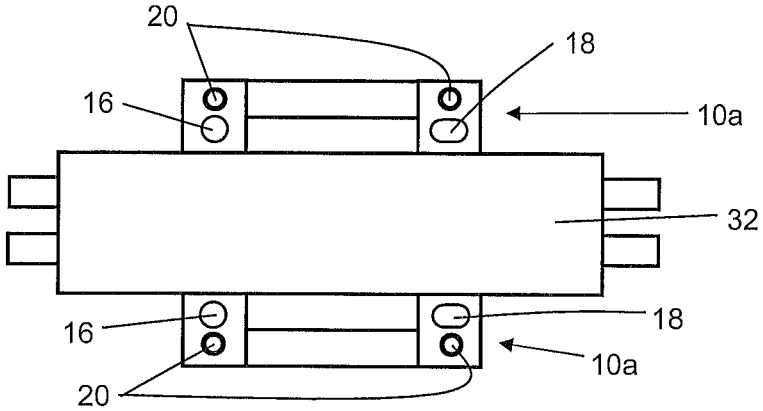

FIG. 8*a* shows the two parts of the holding device 10*a*, each with a slot 18 formed as a hole, a bore 16 and two through and/or tapped holes 20. The through and/or tapped holes 20 serve to fix the holding device 10*a* in the receiving device 36.

Figure 8B:
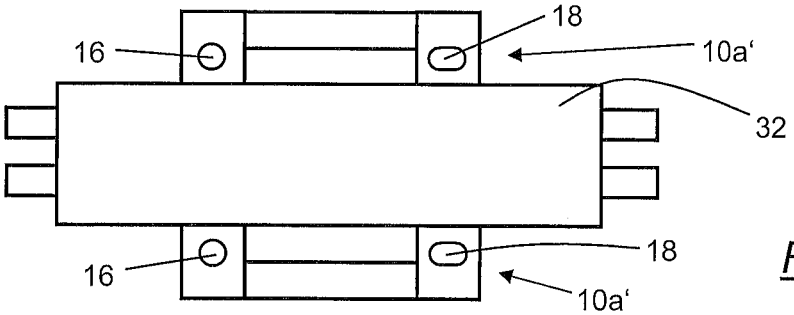

FIG. 8*b* shows the same geometric arrangement of the holes 18 and bores 16 as in FIG. 8*a*. However, in this first alternative variant of the embodiment, the through and/or tapped holes 20 are missing. According to this embodiment, the fixing of the holding device 10*a*' to a receiving device 36 is thus realized, for example, by means of a clamping closure. Such a clamping closure has the advantage that the multipole 32 attached to the holding device 10*a*', which is arranged, for example, in a mass spectrometer, can be exchanged easily and quickly.

Figure 8C:
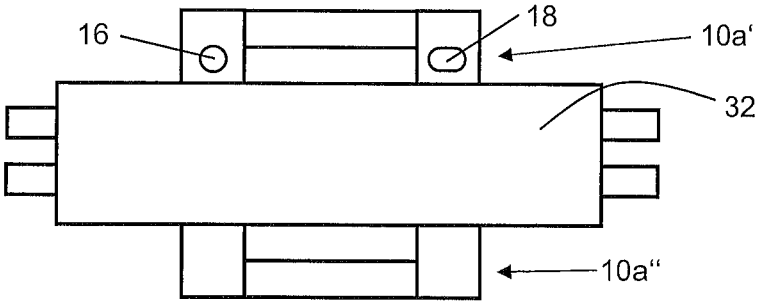

FIG. 8*c* shows a variant of the introduction of the holes 18 and bores 16 in the holding device 10*a*' and 10*a*". In the holding device 10*a*' a hole 18, preferably a slotted hole, and a bore 16, as shown in FIG. 8*b*, are introduced. The holding device 10*a*" in turn has neither a hole nor a bore. Thus, the multipole 32 is locked and centered only by one of the two holding devices 10*a*' and 10*a*".

Figure 8D:
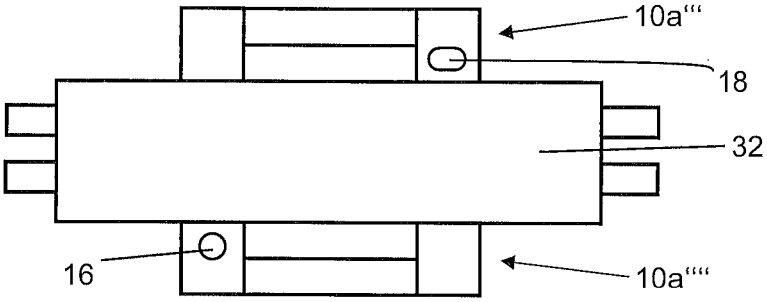

FIG. 8*d* shows a further variant, wherein the holding device 10*a*'" has a hole 18 which is preferably designed as a slotted hole and the second holding device 10*a*'" has a bore 16. The hole 18 and the bore 16 are arranged to each other such that they are on a diagonal with respect to the central longitudinal axis of the multipole 32.

The fixing of the holding device 10*a*' to 10*a*'" on the receiving device 36 is carried out according to FIGS. 8*c* and 8*d* analogous to FIG. 8*b* by means of a clamping closure. In the event, however, that a fixation via at least one fixing screw 52 is provided, additionally through and/or tapped holes 20 in the holding devices 10*a*' to 10*a*'" are provided, which, however, are not shown in FIGS. 8*c* and 8*d*.

In the embodiments of the bores 16, holes 18 and through and/or tapped holes 20, as shown in FIGS. 8*a-d*, these can also be combined for the use of a single fastening element 38, whereby the use of a dowel pin screw as a fastening element 38 is possible.

The above-described embodiments 10*a* to 10*a*''' of the bores 16, holes 18 and through holes and/or tapped holes 20 can be applied analogously to the various embodiments 10*a-c* of the holding device 10 according to FIGS. 7*a-d*.

FIG. 9 shows the multipole 32 according to FIG. 4 without the receiving device 36 shown in FIG. 4. The outer contours of the electrode half-shells 26 are shown exaggeratedly inaccurate. The two parts 10*a* of the holding device 10 are attached to surfaces of the prismatic structures 30, which are machined together in one working step with the electrodes 26A, 26B of an electrode half-shell 26. For this purpose, these electrodes 26A, 26B are first fixed, e.g. glued, via insulators 54 with half-shell elements 56. This processing is done, for example, with a single grindstone. Thus, a precise position of the machined surfaces of the electrodes 26A, 26B and the surfaces of the prismatic structures 30 to each other is ensured.

As a result of this precise arrangement of the surfaces of the prismatic structures 30, the parts 10*a* of the holding device 10 can also be aligned very precisely with the processed electrode surfaces. This allows an exact spacing of the dowel holes 16 to the center M of the processed electrode surfaces. The multipole can thus easily be installed and aligned in a high-precision manner in the mass spectrometer.

FIG. 10 shows the multipole according to FIG. 9 without the holding device according to the invention shown in FIG. 9, but with a conventional ring-shaped holding device 58 for illustrating an undesired offset X in the x-direction and Y in the y-direction of the common center point M of the processed electrode surfaces of the multipole 32 with respect to the center N of the outer contour of the electrode half-shells 26 and thus the annular contoured holding device 58 conventionally attached to this outer contour. Such an offset can be avoided due to the invention. The invention therefore contributes to significantly increase the measurement accuracy of mass spectrometers.

All of the features mentioned in the foregoing description and in the claims can be combined individually or in any combination with the features of the independent claims. The disclosure of the invention is therefore not limited to the described or claimed feature combinations. Rather, all meaningful combinations of features in the context of the invention are to be regarded as disclosed.

The invention claimed is:

1. An assembly comprising:

(a) a multipole comprising multipole surfaces, two electrode half-shells and electrodes arranged on the electrode half-shells; and (b) a holding device attached to the multipole;

wherein the holding device has at least one planar supporting surface for fastening the multipole to a receiving device for receiving the holding device;

wherein the multipole surfaces and the electrodes are manufactured together in one work step by grinding with the same grindstone so that the multipole surfaces thus have a clear and exact geometric reference to the thus formed ground surfaces of the electrodes; and wherein the holding device is attached to the multipole surfaces.

2. The assembly according to claim 1, wherein the holding device is arranged laterally of the multipole in the region of a cylindrical surface surrounding the multipole.

3. The assembly according to claim 2, wherein the holding device is arranged in a central section of the surrounding cylindrical surface, this central section being symmetrical to the central transverse axis of the multipole and corresponding to a maximum of 90% of the cylindrical surface.

4. The assembly according to claim 1, wherein the holding device has at least one positioning means for aligning the holding device on the receiving device.

5. The assembly according to claim 4, wherein the at least one positioning means of the holding device is formed by a hole and/or a bore in the holding device;

wherein the at least one positioning means is configured to receive a fastener designed to fit the hole and/or the bore, in the radial direction of the fastener for positively connecting the holding device to the receiving device; and wherein the at least one positioning means in the holding device is arranged to correspond with an arrangement of at least one receiving element in the receiving device.

6. The assembly according to claim 5, wherein the holding device comprises at least one slotted hole having a width equal to the diameter of a correspondingly arranged receiving hole in the receiving device and at least one bore having a diameter equal to the width of the at least one slotted hole.

7. The assembly according to claim 1, wherein the holding device is connectable via roof edge and prismatic connections with the multipole;

wherein the multipole can be dismantled along its central longitudinal axis into at least two electrode shells joinable together via the roof edge and prismatic connections;

wherein each roof edge and prismatic connection has a roof edge structure and either a prism structure on the electrode shells corresponding to the roof edge structure or a roof edge element on the holding device and a corresponding prismatic structure formed by the roof edge structure; or wherein the roof edge element is roof-shaped and the prism structure is channel-shaped;

wherein the roof edge structures or roof edge elements are aligned with each other and the prism structures are aligned with each other parallel to the central longitudinal axis of the multipole and each roof edge structure or roof edge element is interlockable with a prismatic structure.

8. The assembly according to claim 1, wherein the holding device comprises through and/or tapped holes arranged to correspond to receiving tapped holes of the receiving device.

9. The assembly according to claim 1, wherein the holding device is configured to be arranged on a receiving device of a mass spectrometer, a mounting unit and/or a unit serving for maintenance of the multipole; and wherein the holding device has at least one roof edge structure and/or at least one prism structure for attachment to the multipole.

10. A mass spectrometer comprising:

(a) the assembly according to claim 1; and (b) a receiving device for receiving the holding device;

wherein said multipole is arranged in an exact geometric position relative to all axial directions of the multipole and relative to other components of the mass spectrometer in the mass spectrometer by means of the holding device of said multipole.

11. The assembly according to claim 1, further comprising a mounting unit with a receiving device for positioning the holding device relative to the multipole arranged on the receiving device, wherein the mounting unit has a bottom plate which is aligned such that the center longitudinal axis of the multipole and the effective direction of gravity are aligned perpendicular to the bottom plate.

12. The assembly according to claim 11, wherein the mounting unit has a rear wall which has recesses through which connecting elements of the holding device for connecting the holding device with the multipole are visible and accessible with a tool.

13. A method, comprising the following steps:

(a) providing the assembly according to claim 1;

(b) form-fitting connecting the holding device with an associated receiving device;

(c) moving the multipole relative to the holding device in the longitudinal direction of the multipole until a predetermined relative position of the multipole to the holding device is achieved; and (d) fixing this relative position.

14. The method according to claim 13, wherein the positive connection of the holding device with the receiving device is effected by means of at least two positioning means.

* * * * *